US010278482B1

(12) United States Patent
McElveen et al.

(10) Patent No.: US 10,278,482 B1
(45) Date of Patent: May 7, 2019

(54) PERSONAL ITEM CARRYING SYSTEM

(71) Applicants: Gloria McElveen, Casselberry, FL (US); Teri McElveen, Gainesville, FL (US)

(72) Inventors: Gloria McElveen, Casselberry, FL (US); Teri McElveen, Gainesville, FL (US)

( * ) Notice: Subject to any disclaimer, the term of this patent is extended or adjusted under 35 U.S.C. 154(b) by 0 days.

(21) Appl. No.: 16/140,867

(22) Filed: Sep. 25, 2018

(51) Int. Cl.
*A45F 5/00* (2006.01)
*H01R 33/92* (2006.01)
*A45F 5/02* (2006.01)

(52) U.S. Cl.
CPC ..... *A45F 5/021* (2013.01); *A45F 2200/0516* (2013.01); *H01R 33/92* (2013.01)

(58) Field of Classification Search
CPC ..... A45F 5/021; A45F 2200/0516; A45F 2200/0508; A45F 2200/0525; H01R 33/92
USPC ..... 224/674, 675, 680, 681, 682, 683, 684, 224/930; D3/224, 225, 226, 230
See application file for complete search history.

(56) References Cited

U.S. PATENT DOCUMENTS 1,968,767 A * 7/1934 Howard ..... F42B 39/02 224/674
D104,572 S * 5/1937 Lewis ..... 224/236
D259,151 S 5/1981 Kishbaugh et al.
4,384,372 A * 5/1983 Rector ..... A41F 9/002 2/300
4,515,300 A * 5/1985 Cohen ..... A45C 1/04 224/153
4,676,419 A * 6/1987 Victor ..... A45F 5/00 224/269
4,848,624 A * 7/1989 Clem ..... A45C 1/04 224/222
4,907,729 A * 3/1990 Hess, III ..... A45C 1/04 224/240
4,923,105 A 5/1990 Snyder
4,957,231 A * 9/1990 Kalisher ..... A01K 97/06 224/240
5,060,835 A 10/1991 Payne
5,240,156 A 8/1993 Sicotte et al.
5,303,860 A * 4/1994 Serafini, Jr. ..... F41C 33/0218 220/324
D348,776 S * 7/1994 Anderson ..... D3/226
5,395,023 A * 3/1995 Naymark ..... A45C 11/38 224/199
D360,295 S * 7/1995 Myatt ..... D3/224
5,501,379 A * 3/1996 Munoz ..... A41F 9/002 224/240
5,586,707 A * 12/1996 Haskell ..... A63B 71/0672 224/242
D379,559 S 6/1997 Maez
D393,365 S * 4/1998 Wheeler ..... D3/226
D395,546 S * 6/1998 Houtan ..... D3/226
D411,659 S 6/1999 Karton
6,120,162 A 9/2000 Guerrieri
(Continued)

*Primary Examiner* — Justin M Larson
(74) *Attorney, Agent, or Firm* — Cramer Patent & Design, PLLC; Aaron R. Cramer

(57) ABSTRACT

An item carrying system incorporates a circumferentially adjustable waist band assembly having a pair of pouches adjustably positionable on either side of the waist band. Each pouch has a plurality of pockets and storage spaces. Each pouch also comprises a solar panel in electric communication with at least one charging port. The entire system is waterproof and buoyant.

20 Claims, 7 Drawing Sheets

(56) References Cited

U.S. PATENT DOCUMENTS

D434,897 S * 12/2000 Hillman ..... D3/218
D497,715 S * 11/2004 Saltarelli ..... D3/226
6,971,562 B2 * 12/2005 Willows ..... A45F 3/16 224/148.4
7,124,921 B1 10/2006 Hubbell
D533,995 S * 12/2006 Booth ..... D3/224
D685,992 S * 7/2013 Benson ..... D3/228
D797,450 S * 9/2017 Willows ..... D3/226
9,818,993 B1 11/2017 Zink
D809,288 S 2/2018 Preseren
D835,402 S * 12/2018 Pomerantz ..... D3/226
2002/0148872 A1 * 10/2002 DeVolentine ..... A45F 3/00 224/665
2004/0262359 A1 * 12/2004 DeVolentine ..... A45F 3/00 224/665
2005/0242144 A1 * 11/2005 Panosian ..... A45F 5/02 224/665
2006/0237509 A1 * 10/2006 Moore, Sr. ..... A45F 3/14 224/675
2009/0039120 A1 * 2/2009 Murdoch ..... A45C 11/38 224/195
2009/0084822 A1 * 4/2009 Crye ..... A45F 5/02 224/674
2009/0302076 A1 * 12/2009 Romano ..... A45F 3/14 224/199
2009/0302082 A1 * 12/2009 Freeny ..... A45F 3/00 224/661
2012/0190413 A1 * 7/2012 Ojeda ..... A45F 5/021 455/575.8
2015/0101958 A1 * 4/2015 Cross ..... A45C 5/14 206/702
2018/0020791 A1 * 1/2018 Cole ..... A45C 3/00 224/576
2018/0020794 A1 * 1/2018 Rao ..... A45C 15/00 320/114
2018/0049493 A1 * 2/2018 Graves ..... A41D 27/20
2018/0140063 A1 * 5/2018 Gomez ..... A45C 1/08

* cited by examiner

PERSONAL ITEM CARRYING SYSTEM

RELATED APPLICATIONS

Non-applicable.

FIELD OF THE INVENTION

The presently disclosed subject matter is directed to a personal item carrying system.

BACKGROUND OF THE INVENTION

There are many tasks that one's performs as part of their job, or just as part of their daily life. Often these tasks require access to small tools or items such as pens, pencils, knives, scissors, flashlights or the like. Other objects such as a cell phone, car keys, a wallet and even eye glasses must be carried as well.

Many without adequate pocket space may turn to the use of a fannie pack to help keep track of these personal items. However, fannie packs suffer from the fact that trying to find a small object buried deep inside is often difficult. Others may find the fact that their potentially heavy weight can make the person feel off center. Finally, should the wearer spend a lot of time outdoors and away from an electrical outlet, they run the risk of rain or other inclement weather ruining the contents of the pack, or running out of power for their personal electronics with no ready means to recharge them. Accordingly, there exists a need for a means by which a fannie pack can be modified to address the above-mentioned concerns. The development of the Personal Item Carrying System fulfills this need.

SUMMARY OF THE INVENTION

The principles of the present invention provide for a waist belt pouch system, comprising a strap assembly having a first strap end and a second strap end, the first strap end and a second strap end are conjoined to each other with a strap coupling. The first strap end and the second strap end are attached to the strap coupling that provides a continuous encircling strap assembly. The first strap end and the second strap end are each attached to the strap coupling with at least one strap fastener, the at least one strap fastener is fixed from the strap coupling, the first strap end has a first adjustment device located along a length thereof to enable relative length adjustment thereof, the first strap end has a portion that loops back through the first adjustment device and has a means to enable retention of a desired position thereof, the second strap end has a portion that loops back through a generally identical functional second adjustment device and has a means to enable retention of a desired position thereof, the at least one strap fastener is detachable from the strap coupling.

The waist belt pouch system also has a first pouch having a first pouch front portion and a first pouch rear portion, the first pouch rear portion is generally a rectangular generally flexible body having a rear wall, a top wall, a bottom wall, and a pair of side walls that define a hollow rear interior, holding stored items therein and the top wall has a first pouch fastener to enable access to the rear interior yet seal the interior from the environment. The rear facing surface of the rear wall of the first pouch rear portion has a first pouch strap loop affixed thereto and oriented such that opposing longitudinal ends thereof are open to the environment, the first pouch front portion is located on the front of the first pouch rear portion and is centered thereon, the first pouch front portion has a front wall, a top wall, a bottom wall, and a pair of sidewalls that defines a hollow front interior.

The system further comprises a second pouch having a second pouch front portion and a second pouch rear portion, the second pouch front portion is located on a front of the second pouch rear portion and centered thereon, the second pouch front portion has a front wall, a top wall, a bottom wall, and a pair of sidewalls that defines a hollow front interior. Affixed or otherwise attached to the front wall of the second pouch front portion is a plurality of pockets, the top wall has a pouch fastener to enable access to the rear interior yet seal the interior from the environment, the pockets are removably attached or affixed to the second pouch front portion, the pockets have a second pouch fastener similar to or different than the pouch fasteners to provide access to interiors thereof, the first pouch and the second pouch are holding various sundries and items typically carried by a user pouch is adjustably positioned on any desired strap end. The first pouch is adjustably positioned along the first strap end of the strap assembly and the second pouch is adjustably positioned along the second strap end, the rear facing surface of the rear wall of the second pouch rear portion has a second pouch strap loop affixed thereto and oriented such that opposing longitudinal ends thereof are open to the environment, the open longitudinal ends are in environmental communication with each other, such that a continuous pass-through section is present, the pass-through section is sized to enable any part of the first strap end or the second strap end of the strap assembly to pass through—thereby enabling the second pouch to be linearly adjustable relative to the strap assembly. The pass-through section is sized so as to not enable the second pouch to traverse over either the adjustment device or the strap coupling, the second pouch front portion is located on a front of the second pouch rear portion and is centered thereon, the second pouch front portion has a front wall, a top wall, a bottom wall, and a pair of sidewalls that defines a hollow front interior.

The strap coupling may be selected from the group consisting of a square material, a rectangular metallic material or a hard-plastic material and the strap assembly may also be selected from the group consisting of a rigid material, a semi-rigid material, or a flexible elongated material having a length capable of encircling a human waist. The pouch fastener may be a waterproof zipper to enable access to the rear interior yet seal the interior from an environment. The first pouch may comprise a transparent material or a somewhat translucent material so as to view the contents therein.

A first pouch pocket flap may be peeled away from the first pouch first pocket via the pouch fastener to illustrate a plurality of first pouch communication ports while the first communication port incorporates an electronic communication port selected from the group consisting of a USB port, a micro-USB port, an RCA port, or an optical port. The pouch fastener may be a waterproof zipper to enable access to the rear interior yet seal the interior from an environment.

The second pouch may comprise a transparent material or a somewhat translucent material so as to view the contents therein while the pockets on the second pouch generally have a curvilinear bottom end, a linear top end and a general U-shape. A second pouch pocket flap is peeled away from the respective pocket via the pouch fastener. The second communication port incorporates an electronic communication port selected from the group consisting of a USB port, a micro-USB port, a Radio Corporation of America or RCA port, or an optical port. A first pouch pocket flap is peeled away from the first pouch first pocket via the pouch fastener to illustrate a plurality of first pouch communication ports. The first communication port incorporates an electronic communication port selected from the group consisting of a USB port, a micro-USB port, a Radio Corporation of America or RCA port, or an optical port.

Each of the communication ports are selectively plugged so as to protect the communication port when not in use. Each of the first communication ports has a first communication port plug attached via a first tether immediately subjacent from the first communication port and has a cover portion affixed to the first tether and an extension portion extending away from a side of the cover portion and the first communication port plug is sized and shaped similar to a charging connector of a cord and fully covers the electrical contacts therein.

Each of the second communication ports has a second communication port plug attached via a second tether immediately subjacent from the second communication port and the second communication port plug has a cover portion affixed to the second tether and an extension portion extending away from a side of the cover portion and is sized. Each of the second communication ports may also be shaped similar to a charging connector of a cord and fully covers a plurality of electrical contacts therein. The waist belt pouch system is particularly suited for individuals who have a plurality of items to carry and a plurality of pockets of pants or shorts are inadequate to carry all of the items. The system may also be able to float.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
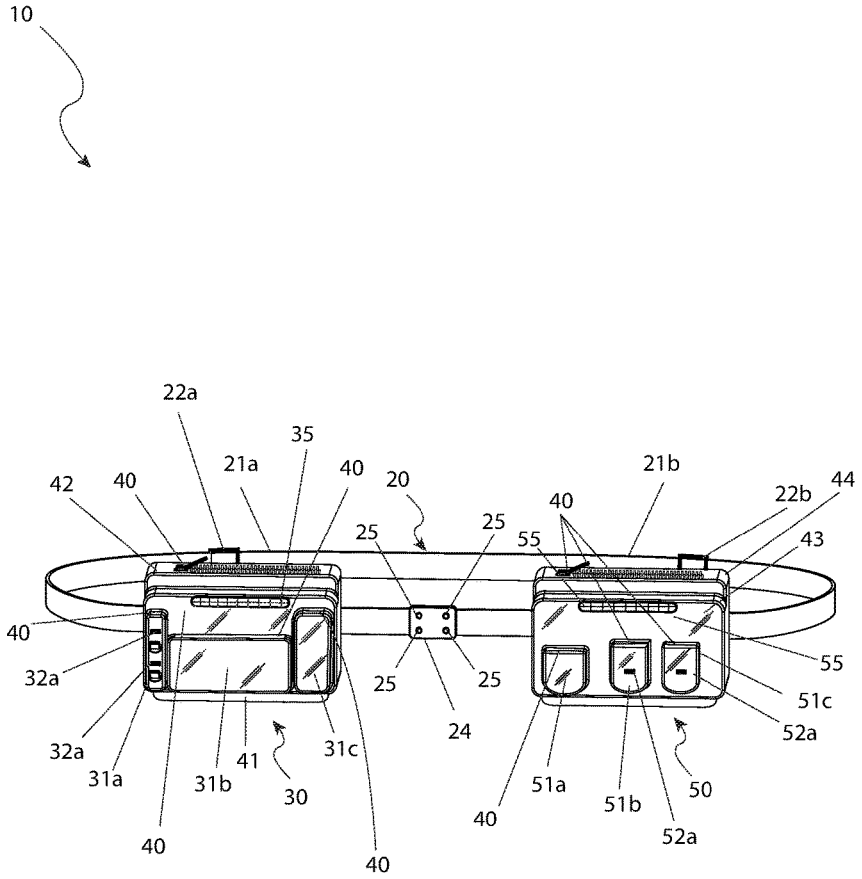
FIG. 1 is a front perspective view of the waist belt pouch system 10, according to the preferred embodiment of the present invention.
Figure 2A:
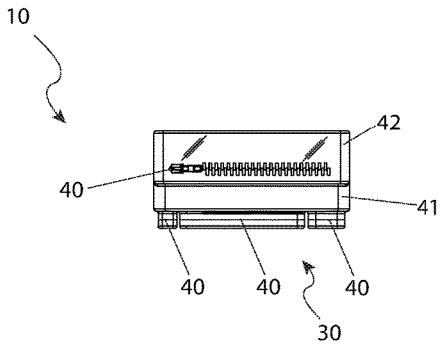
FIG. 2*a* is a top plan view of the first pouch 30, according to the preferred embodiment of the present invention.
Figure 2B:
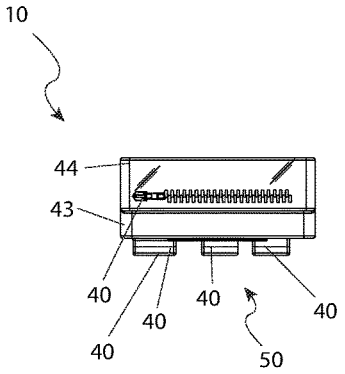
FIG. 2*b* is a top plan view of the second pouch 50, according to the preferred embodiment of the present invention.
Figure 3A:
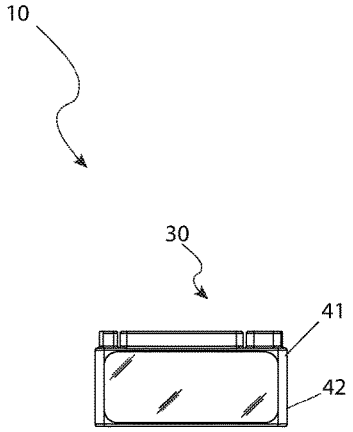
FIG. 3*a* is a bottom plan view of the first pouch 30, according to the preferred embodiment of the present invention.
Figure 3B:
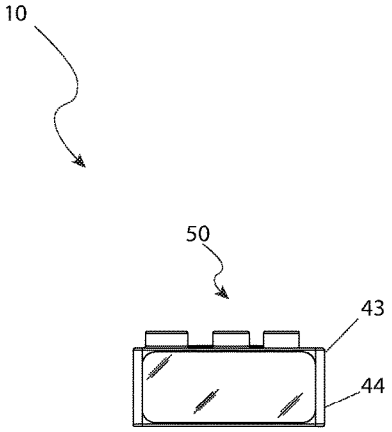
FIG. 3*b* is a bottom plan view of the second pouch 50, according to the preferred embodiment of the present invention.

10 waist belt pouch system
20 strap assembly
21*a* first strap side
21*b* second strap side
22*a* first adjustment device
22*b* second adjustment device
24 strap coupling
25 strap fastener
30 first pouch
31*a* first pouch first pocket
31*b* first pouch second pocket
31*c* first pouch third pocket
31*d* first pouch pocket flap
32*a* first pouch communication port
32*b* first pouch communication port plug
32*c* first tether
33 first pouch battery
35 first pouch solar array
36 first pouch solar cell
37*a* first pouch solar charge controller
37*b* first pouch over-current protection device
37*c* first pouch power supply
38 first pouch strap loop
40 pouch fastener
41 first pouch front portion
42 first pouch rear portion
43 second pouch front portion
44 second pouch rear portion
50 second pouch
51*a* second pouch first pocket
51*b* second pouch second pocket
51*c* second pouch third pocket
51*d* second pouch pocket flap
52*a* second pouch communication port
52*b* second pouch communication port plug
52*c* second tether
53 second pouch battery
55 second pouch solar array
56 second pouch solar cell
57*a* second pouch solar charge controller
57*b* second pouch over-current protection device
57*c* second pouch power supply
58 second pouch strap loop
60 wiring
65 portable electronic device
66 charging cord
67 charging connector

DESCRIPTION OF THE PREFERRED EMBODIMENTS

The best mode for carrying out the invention is presented in terms of its preferred embodiment, herein depicted within FIGS. 1 through 10. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIG. 1, a perspective view of the waist pouch system (herein described as the "system") 10, which shows a first pouch 30 and a second pouch 50, each adjustably positionable about a strap assembly 20. The strap assembly 20 is configurable to be worn about the waist of a user. Each pouch 30, 50 has a plurality of pockets each capable of holding various sundries and items typically carried by a user. The system 10 is particularly suited for individuals who have a plurality of items to carry and the pockets of normal pants or shorts are inadequate to carry all of them.

Figure 4:
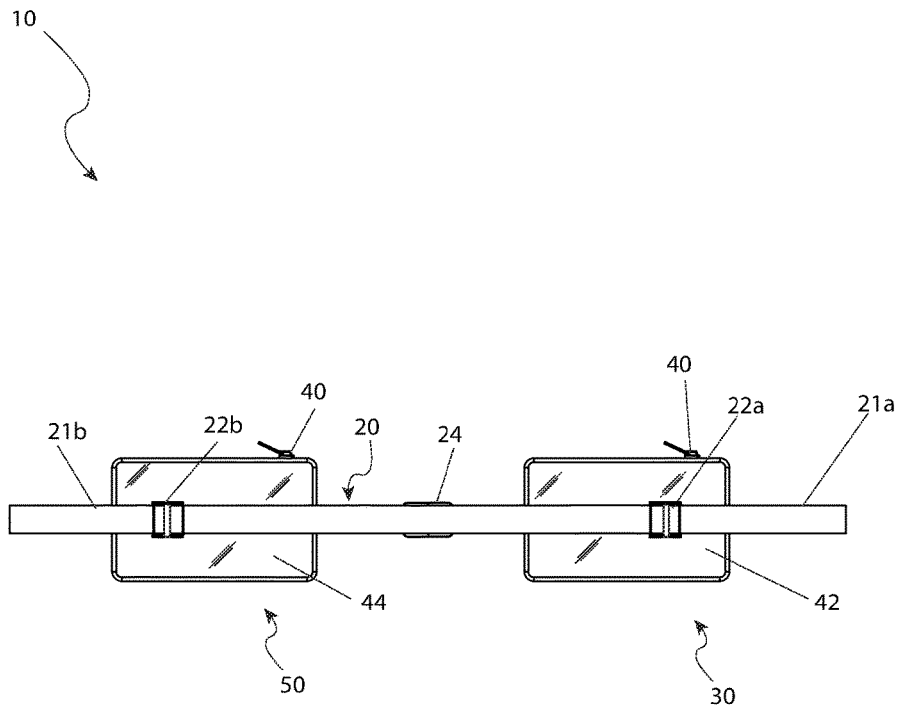
FIG. 4 is a rear elevation view of the waist belt pouch system 10, according to the preferred embodiment of the present invention.
Figure 5:
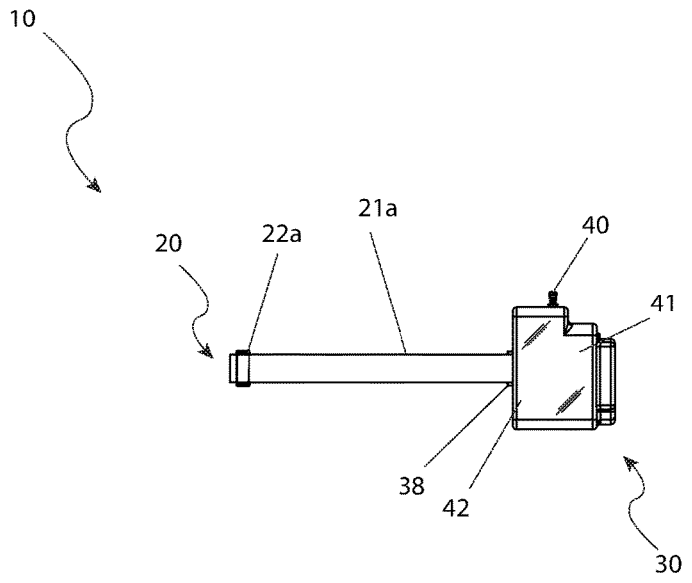
FIG. 5 is a left elevation view of the waist belt pouch system 10, according to the preferred embodiment of the present invention.
Figure 6:
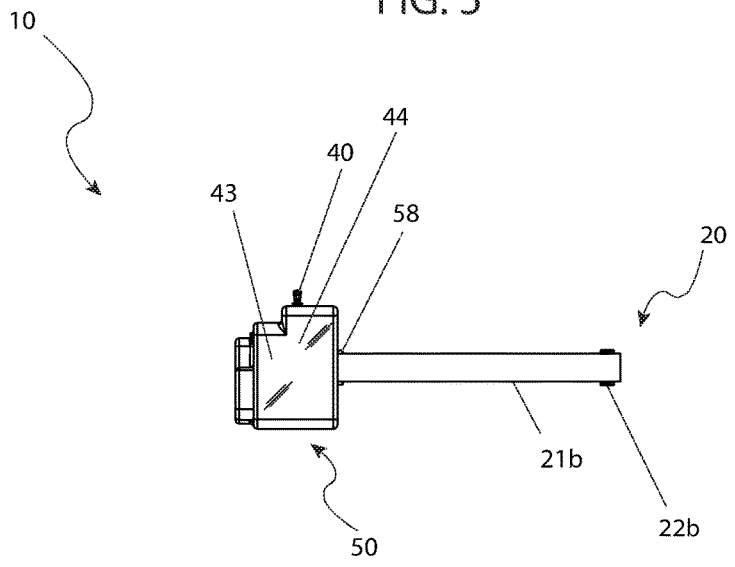
FIG. 6 is a right elevation view of the waist belt pouch system 10, according to the preferred embodiment of the present invention.

Referring now to FIGS. 1 and 4, the strap assembly 20 can be a rigid, semi-rigid, or flexible elongated material, having a length capable of encircling a human waist. The strap assembly 20 is defined as having a strap first side 21*a* and a strap second side 21*b*, which are conjoined to each other with a strap coupling 24, which in an exemplary embodiment is a square or rectangular metallic or hard plastic material. The strap first end 21*a* and strap second end 21*b* are each attached to the strap coupling 24 with a at least one (1) strap fastener 25. It is appreciated that the straps first end 21*a* and strap second end 21*b* are attached to the strap coupling 24 such that it provides a continuous encircling strap assembly 20. The strap fasteners 25 may be fixed or detachable from the strap coupling 24. The strap first end 21*a* has a first adjustment device 22*a* located along a length thereof to enable relative length adjustment thereof. In such an embodiment, the strap first end 21*a* has a portion that loops back through the first adjustment device 22*a* and has a means to enable retention of a desired position thereof. Similarly, the strap second end 21*a* has a generally identically functional second adjustment device 22*b*.

Referring now to FIGS. 2*a*, 2*b*, 3*a*, 3*b*, 5, and 6, which illustrate various views of the features of the first pouch 30 and second pouch 50. As previously mentioned, the first pouch 30 and second pouch 50 each preferably comprise a transparent or somewhat translucent material so as to view the contents therein. It is also preferred that each pouch 30, 50, and indeed the entire system 10, should be able to float on water. It is also appreciated that although the illustrations herein show that the first pouch 30 is adjustably positioned along the first strap end 21*a* of the strap assembly 20 ands the second pouch 50 is adjustably positioned along the second strap end 21*b*, either pouch 30, 50 can be adjustably positioned on any desired strap end 21*a*, 21*b* and fully function as described herein. Also, the first pouch 30 and second pouch 50 are very similar in shape, size, and interior holding capacity and will be more specifically described below.

The first pouch 30 has a first pouch front portion 41 and a first pouch rear portion 42. The first pouch rear portion 42 is generally a rectangular generally flexible body having a rear wall, a top wall, a bottom wall, and a pair of side walls that define a hollow rear interior, capable of holding stored items therein. The top wall has a pouch fastener 40, which is preferably a waterproof zipper or similar device to enable access to the rear interior yet seal the interior from the environment. The rear facing surface of the rear wall of the first pouch rear portion 42 has a first pouch strap loop 38 affixed thereto and oriented such that opposing longitudinal ends thereof (those adjacent to the sidewalls) are open to the environment. The open longitudinal ends are in environmental communication with each other, such that a continuous pass-through section is present. This pass-through section is sized to enable any part of the strap first end 21*a* or strap second end 21*b* of the strap assembly 20 to pass through, thereby enabling the first pouch 30 to be linearly adjustable relative to the strap assembly 20. The pass-through section is sized so as to not enable the first pouch 30 to traverse over either adjustment device 22*a*, 22*b*, or strap coupling 24.

The first pouch front portion 41 is located on the front of the first pouch rear portion 42 and preferably centered thereon. The first pouch front portion 41 has a front wall, a top wall, a bottom wall, and a pair of sidewalls that defines a hollow front interior. In a preferred embodiment, the width of the first pouch front portion 41 and first pouch rear portion 42 are coextensive, yet the height of the first pouch front portion 41 is less than the first pouch rear portion 42. In some embodiments, the first pouch front portion 41 has a rear wall that is affixed to a front wall of the first pouch rear portion 42. In such an embodiment, this means that the front interior is not in environmental communication with the rear interior and are separate. In such an embodiment, the first pouch front portion 41 comprises a pouch fastener 40 similar in construction as the pouch fastener 40 of the first pouch rear portion 42 and located on the top wall of the first pouch front portion 41. In other embodiments, the rear wall of the first pouch front portion 41 and the front wall of the first pouch rear portion 42 are defined as the same wall. In still yet another embodiment, there is no rear wall of the first pouch front portion 41 and no front wall of the first pouch rear portion 42, thereby enabling the front interior and rear interior to be in environmental communication with each other. In such an embodiment, the pouch fastener 40 on the top wall of the first pouch front portion 41 may be present or not.

Affixed or otherwise attached to the front wall of the first pouch front portion 41 is a plurality of pockets 31*a*, 31*b*, 31*c*. The number of pockets 31*a*, 31*b*, 31*c* in the exemplary embodiment numbers three (3), but it is appreciated that the number, orientation, and location of pockets 31*a*, 31*b*, 31*c* can vary. The pockets can be removably attached or affixed to the first pouch front portion 41 and can have similar material. The pockets 31*a*, 31*b*, 31*c* also have a pouch fastener 40 similar to or different than the aforementioned pouch fasteners 40 to provide access to interiors thereof, by separating the respective pocket flap 31*d*, 51*d*. A more detailed description of the pockets 31*a*, 31*b*, 31*c*, will be described below.

The second pouch 50 generally has similar or identical features as the aforementioned first pouch 30. More specifically, the second pouch 50 has a second pouch front portion 43 and a second pouch rear portion 44. The second pouch rear portion 44 is generally a rectangular generally flexible body having a rear wall, a top wall, a bottom wall, and a pair of side walls that define a hollow rear interior, capable of holding stored items therein. The top wall has a pouch fastener 40, which is preferably a waterproof zipper or similar device to enable access to the rear interior yet seal the interior from the environment. The rear facing surface of the rear wall of the second pouch rear portion 44 has a second pouch strap loop 58 affixed thereto and oriented such that opposing longitudinal ends thereof (those adjacent to the sidewalls) are open to the environment. The open longitudinal ends are in environmental communication with each other, such that a continuous pass-through section is present. This pass-through section is sized to enable any part of the strap first end 21*a* or strap second end 21*b* of the strap assembly 20 to pass through, thereby enabling the second pouch 50 to be linearly adjustable relative to the strap assembly 20. The pass-through section is sized so as to not enable the second pouch 50 to traverse over either adjustment device 22*a*, 22*b*, or strap coupling 24.

The second pouch front portion 43 is located on the front of the second pouch rear portion 44 and preferably centered thereon. The second pouch front portion 43 has a front wall, a top wall, a bottom wall, and a pair of sidewalls that defines a hollow front interior. In a preferred embodiment, the width of the second pouch front portion 43 and second pouch rear portion 44 are coextensive, yet the height of the second pouch front portion 43 is less than the second pouch rear portion 44. In some embodiments, the second pouch front portion 43 has a rear wall that is affixed to a front wall of the second pouch rear portion 44. In such an embodiment, this means that the front interior is not in environmental communication with the rear interior and are separate. In such an embodiment, the second pouch front portion 43 comprises a pouch fastener 40 similar in construction as the pouch fastener 40 of the second pouch rear portion 44 and located on the top wall of the second pouch front portion 43. In other embodiments, the rear wall of the second pouch front portion 43 and the front wall of the second pouch rear portion 44 are defined as the same wall. In still yet another embodiment, there is no rear wall of the second pouch front portion 43 and no front wall of the second pouch rear portion 44, thereby enabling the front interior and rear interior to be in environmental communication with each other. In such an embodiment, the pouch fastener 40 on the top wall of the second pouch front portion 43 may be present or not.

Affixed or otherwise attached to the front wall of the second pouch front portion 43 is a plurality of pockets 51*a*, 51*b*, 51*c*. The number of pockets 51*a*, 51*b*, 51*c* in the exemplary embodiment numbers three (3), but it is appreciated that the number, orientation, and location of pockets 51*a*, 51*b*, 51*c* can vary. The pockets can be removably attached or affixed to the second pouch front portion 43 and can have similar material. The pockets 51*a*, 51*b*, 51*c* also have a pouch fastener 40 similar to or different than the aforementioned pouch fasteners 40 to provide access to interiors thereof. A more detailed description of the pockets 51*a*, 51*b*, 51*c*, will be described below.

Figure 7:
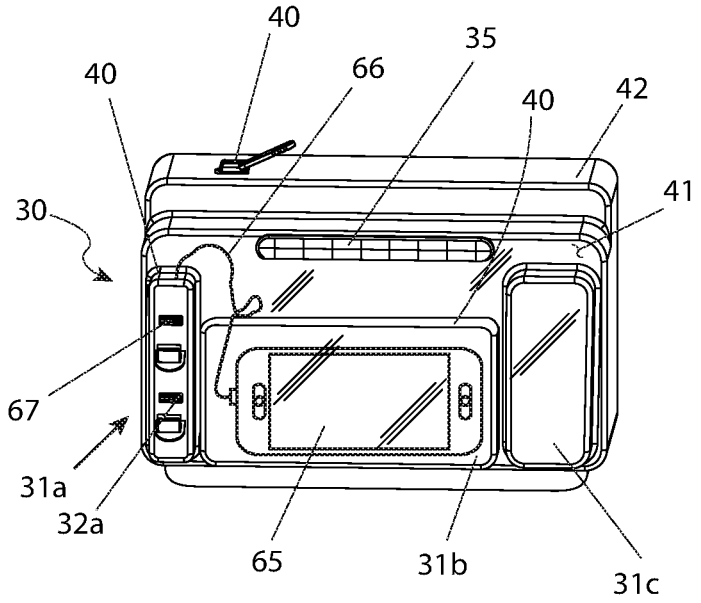
FIG. 7 is a front perspective view of the first pouch 30, according to the preferred embodiment of the present invention.
Figure 8A:
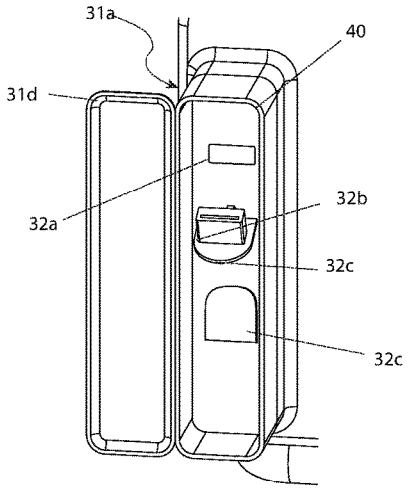
FIG. 8*a* is a close-up front perspective view of the first pouch first pocket 31*a*, according to the preferred embodiment of the present invention.

Referring now more closely now to the pockets 31*a*, 31*b*, 31*c* on the first pouch 30, which are illustrated in FIGS. 1, 7, and 8*a*, it is seen that a first pouch first pocket 31*a* is located at the left side of the front wall and adjacent the left sidewall. The first pouch first pocket 31*a* has a short width (approximately one-eighth (⅛) the width of the first pouch front portion 41) and an elongated length (having a bottom end substantially terminating at the bottom perimeter edge of the first pouch front portion 41 and an upper end terminating prior to the upper perimeter edge of the first pouch front portion 41). A first pouch second pocket 31*b* is located immediately adjacent the first pouch first pocket 31*a* towards the center of the first pouch front portion 41 and has an elongated width (approximately five-eighths (⅝) the width of the first pouch front portion 41) and a shortened length (having a bottom end substantially terminating at the bottom perimeter edge of the first pouch front portion 41 and an upper end terminating lower than the upper perimeter edge of the first pouch first pocket 31*a*). A first pouch third pocket 31*c* is located at the right side of the front wall and adjacent the right sidewall and immediately adjacent the first pouch second pocket 31*b*. The first pouch third pocket 31*a* has a shortened width (approximately one-fourth (¼) the width of the first pouch front portion 41) and an elongated length (having a bottom end substantially terminating at the bottom perimeter edge of the first pouch front portion 41 and an upper end terminating prior to the upper perimeter edge of the first pouch front portion 41).

FIG. 7 illustrates a preferred size and use of the first pouch first pocket 31*a*. A first pouch pocket flap 31*d* is peeled away from the first pouch first pocket 31*a* via the pouch fastener 40 to illustrate a plurality of first pouch communication ports 32*a*. The first pouch second pocket 31*b* is capable of holding a portable electronic device 60 therein. The first pouch third pocket 31*c* is capable of retaining any desired items therein that would fit. Although not illustrated herein, the first pouch second pocket 31*b* and first pouch third pocket 31*c* also incorporate a first pouch pocket flap 31*d*. Located on the front wall of the first pouch front portion 41 is a first pouch solar array 35, substantially positioned adjacent the top perimeter edge of the first pouch front portion 41 and about the same width as the first pouch second pocket 31*b*. The first communication ports 32*a* can incorporate typical electronic communication ports, such as USB, micro-USB, RCA, optical, etc.

Figure 8B:
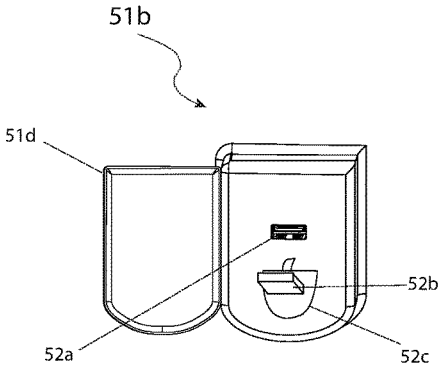
FIG. 8*b* is a close-up front perspective view of the second pouch second pocket 51*b*, according to the preferred embodiment of the present invention.
Figure 8C:
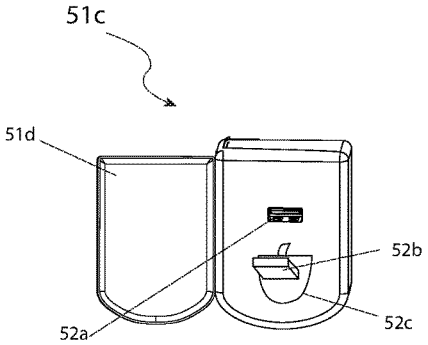
FIG. 8*c* is a close-up front perspective view of the second pouch third pocket 51*c*, according to the preferred embodiment of the present invention.

Referring now more closely now to the pockets 51*a*, 51*b*, 51*c* on the second pouch 50, which are illustrated in FIGS. 1, 8*b*, and 8*c*, it is seen that the pockets 51, 51*b*, and 51*c*, generally have a curvilinear bottom end and a linear top end, such that they have general "U"-shape. A second pouch first pocket 51*a* is located near the left side of the front wall and adjacent the left sidewall. The second pouch first pocket 51*a* has a shortened width (approximately one-fourth (¼) the width of the second pouch front portion 43) and an elongated length (having a bottom apex substantially terminating at the bottom perimeter edge of the second pouch front portion 43 and an upper end terminating approximately one-half (½) the length of the second pouch front portion 43). A second pouch first pocket 51*a* is located adjacent the second pouch first pocket Ma at a minimal distance therefrom and positioned near the center of the second pocket front portion 43 and also has a shortened width (approximately one-fourth (¼) the width of the second pouch front portion 43) and an elongated length (having a bottom apex substantially terminating at the bottom perimeter edge of the second pouch front portion 43 and an upper end terminating approximately one-half (½) the length of the second pouch front portion 43). A second pouch third pocket 51*c* is located adjacent the second pouch second pocket 51*b* at a minimal distance therefrom and positioned near the right side of the front wall and adjacent the right sidewall. The second pouch third pocket 51*c* also has a shortened width (approximately one-fourth (¼) the width of the second pouch front portion 43) and an elongated length (having a bottom apex substantially terminating at the bottom perimeter edge of the second pouch front portion 43 and an upper end terminating approximately one-half (½) the length of the second pouch front portion 43).

FIGS. 8*a* and 8*b* illustrate a preferred use of the second pouch second pocket 51*b* and second pouch third pocket 51*c*, each incorporating a second pouch communication port 52*a*. A second pouch pocket flap 51*d* is peeled away from the respective pocket 51*b*, 51*c* via the pouch fastener 40. The second pouch first pocket Ma is capable of retaining any desired items therein that would fit. Although not illustrated herein, the second pouch first pocket 51*a* also incorporate a second pouch pocket flap 51*d*. Located on the front wall of the second pouch front portion 43 is a second pouch solar array 55, substantially positioned adjacent the top perimeter edge of the second pouch front portion 43 and about the same width as the first pouch second pocket 31*b*. Similar to the first communication port 32*a*, the second communication ports 52*a* can incorporate typical electronic communication ports, such as USB, micro-USB, RCA, optical, etc.

Referring even more closely to FIGS. 8*a*-8*c*, it is shown that each of the communication ports 32*a*, 52*a*, are capable of being selectively plugged so as to protect the respective communication port 32*a*, 52*a* when not in use. Each first communication port 32*a* has a first communication port plug 32*b* attached via a first tether 32*c* immediately subjacent from the first communication port 32*a*. The first communication port plug 32*b* has a cover portion affixed to the first tether 32*c* and an extension portion extending away from a side of the cover portion. The first communication port plug 32*b* is sized and shaped similar to a charging connector 67 of a cord 66 and fully covers the electrical contacts therein. Similarly, each second communication port 52*a* has a second communication port plug 52*b* attached via a second tether 52*c* immediately subjacent from the second communication port 52*a*. The second communication port plug 52*b* has a cover portion affixed to the second tether 52*c* and an extension portion extending away from a side of the cover portion. The second communication port plug 52*b* is sized and shaped similar to a charging connector 67 of a cord 66 and fully covers the electrical contacts therein.

Figure 9:
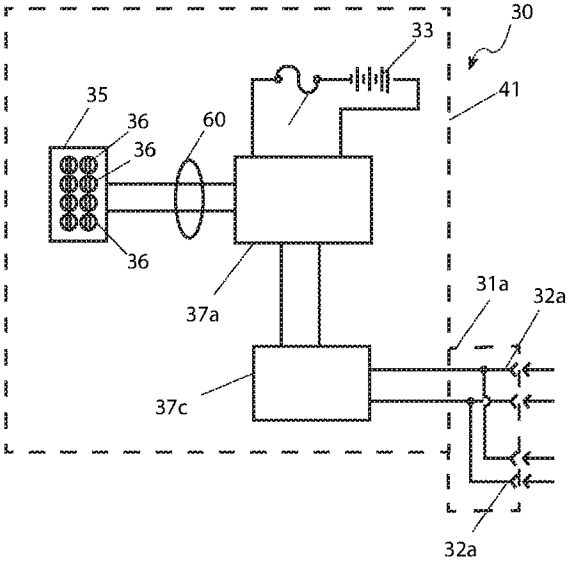
FIG. 9 is an electrical schematic of the first pouch 30, according to the preferred embodiment of the present invention; and, FIG. 10 is an electrical schematic of the second pouch 50, according to the preferred embodiment of the present invention.

FIG. 9 illustrates an electrical schematic of the electrical components of the system 10 within the first pouch 30. The first pouch solar array 35 incorporates a plurality of first pouch solar cells 36 and located on the first pouch front portion 41 and generates a current of energy due to receipt of solar power. A first pouch solar charge controller 37*a* is located within the first pouch 30 and preferably in the first pouch rear portion 42 is in electrical communication with the first pouch solar array 35 via wiring 60. The first pouch solar charge controller 37*a* shunts the current generated through the first pouch over-current protection device 37*b* to the first pouch battery 33. The first pouch battery 33 then releases power on-demand through the first pouch solar charge controller 37*a* to the first pouch power supply 37*d*, with which it is in electrical communication. The first pouch power supply 37*d* then delivers power to the first pouch communication ports 32*a* and subsequently any charging connector 67 attached thereto.

Figure 10:
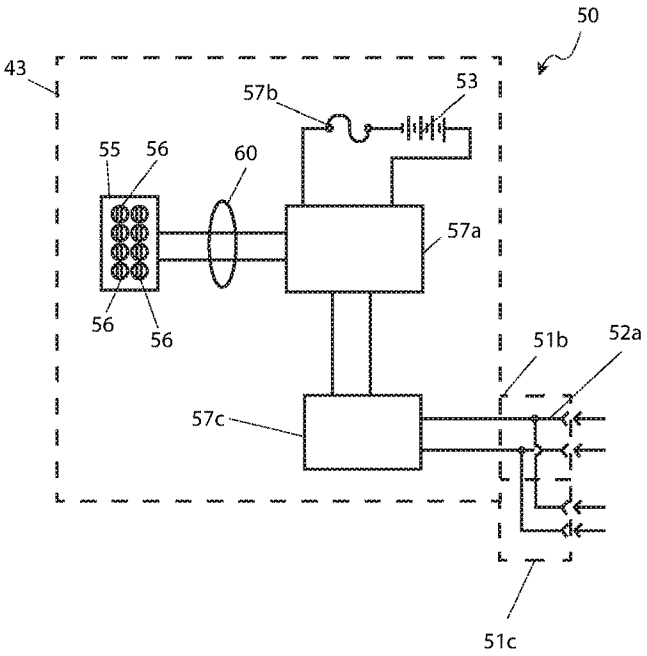

FIG. 10, in a similar manner to FIG. 9, illustrates an electrical schematic of the electrical components of the system 10 within the second pouch 30. The second pouch solar array 55 incorporates a plurality of second pouch solar cells 56 and located on the second pouch front portion 43 and generates a current of energy due to receipt of solar power. A second pouch solar charge controller 57*a* is located within the second pouch 50 and preferably in the second pouch rear portion 44 is in electrical communication with the second pouch solar array 55 via wiring 60. The second pouch solar charge controller 57*a* shunts the current generated through the second pouch over-current protection device 57*b* to the second pouch battery 53. The second pouch battery 53 then releases power on-demand through the second pouch solar charge controller 57*a* to the second pouch power supply 57*d*, with which it is in electrical communication. The second pouch power supply 57*d* then delivers power to the second pouch communication ports 52*a* and subsequently any charging connector 67 attached thereto.

The first pouch 30 and second pouch 50 can each have an interior frame or rigid interior perimeter to maintain the overall shape of either the front portions 41, 43, rear portions 42, 44, both, or neither. FIG. 7 illustrates the most preferred method o fuse of the invention. The first pouch second docket 32*b* is sized and shaped to securely retain a portable electronic device 60 therein, such as a mobile telephone. A charging cord 66 in electrical communication with the portable electronic device 60 has a charging connector 67 capable of being connected to any one (1) of the communication ports 32*a*, 52*a*, but in the present illustration, is most beneficially and conveniently attached to one (1) of the first communication ports 52 within the first pouch first pocket 32*a*. The pouch fasteners 40 crimp or frictionally secure the cord 66 as it passes through the first pouch pocket flaps 32*d* of each pocket 32*a*, 32*b*.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A waist belt pouch system, comprising:

a strap assembly having a first strap end and a second strap end, the first strap end and a second strap end are conjoined to each other with a strap coupling, the first strap end and the second strap end are attached to the strap coupling that provides a continuous encircling strap assembly, the first strap end and the second strap end are each attached to the strap coupling with at least one strap fastener, the at least one strap fastener is fixed from the strap coupling, the first strap end has a first adjustment device located along a length thereof to enable relative length adjustment thereof, the first strap end has a portion that loops back through the first adjustment device and has a means to enable retention of a desired position thereof, the second strap end has a portion that loops back through a second adjustment device and has a means to enable retention of a desired position thereof, the at least one strap fastener is detachable from the strap coupling;

a first pouch having a first pouch front portion and a first pouch rear portion, the first pouch rear portion having a rear wall, a top wall, a bottom wall, and a pair of side walls that define a hollow rear interior for holding stored items therein, the top wall has a first pouch fastener to enable access to the rear interior yet seal the interior from the environment, the rear facing surface of the rear wall of the first pouch rear portion has a first pouch strap loop affixed thereto and oriented such that opposing longitudinal ends thereof are open to the environment, the first pouch front portion is located on the front of the first pouch rear portion and is centered thereon, the first pouch front portion has a front wall, a top wall, a bottom wall, and a pair of sidewalls that defines a hollow front interior; and a second pouch having a second pouch front portion and a second pouch rear portion, the second pouch front portion is located on a front of the second pouch rear portion and centered thereon, the second pouch front portion has a front wall, a top wall, a bottom wall, and a pair of sidewalls that defines a hollow front interior, affixed or otherwise attached to the front wall of the second pouch front portion is a plurality of pockets, the top wall has a pouch fastener to enable access to the rear interior yet seal the interior from the environment, the pockets have a second pouch fastener to provide access to interiors thereof, the first pouch and the second pouch for holding various sundries and items typically carried by a user pouch is adjustably positioned on any desired strap end, the first pouch is adjustably positioned along the first strap end of the strap assembly and the second pouch is adjustably positioned along the second strap end, the rear facing surface of the rear wall of the second pouch rear portion has a second pouch strap loop affixed thereto and oriented such that opposing longitudinal ends thereof are open to the environment, the open longitudinal ends are in environmental communication with each other, such that a continuous pass-through section is present, the pass-through section is sized to enable any part of the first strap end or the second strap end of the strap assembly to pass through, thereby enabling the second pouch to be linearly adjustable relative to the strap assembly, the pass-through section is sized so as to not enable the second pouch to traverse over either the adjustment device or the strap coupling, the second pouch front portion is located on a front of the second pouch rear portion and is centered thereon, the second pouch front portion has a front wall, a top wall, a bottom wall, and a pair of sidewalls that defines a hollow front interior.

2. The waist belt pouch system according to claim 1, wherein the strap coupling is selected from the group consisting of a square material, a rectangular metallic material or a hard-plastic material.

3. The waist belt pouch system according to claim 1, wherein the strap assembly is selected from the group consisting of a rigid material, a semi-rigid material, or a flexible elongated material having a length capable of encircling a human waist.

4. The waist belt pouch system according to claim 1, wherein the pouch fastener is a waterproof zipper to enable access to the rear interior yet seal the interior from an environment.

5. The waist belt pouch system according to claim 1, wherein the first pouch comprises a transparent or translucent material so as to view the contents therein.

6. The waist belt pouch system according to claim 1, wherein a first pouch pocket flap is peeled away from the first pouch first pocket via the pouch fastener to illustrate a plurality of first pouch communication ports.

7. The waist belt pouch system according to claim 6, wherein the first communication port incorporates an electronic communication port selected from the group consisting of a USB port, a micro-USB port, an RCA port, or an optical port.

8. The waist belt pouch system according to claim 1, wherein the pouch fastener is a waterproof zipper to enable access to the rear interior yet seal the interior from an environment.

9. The waist belt pouch system according to claim 1, wherein the second pouch comprises a transparent material or a somewhat translucent material so as to view the contents therein.

10. The waist belt pouch system according to claim 1, wherein the pockets on the second pouch have a curvilinear bottom end, a linear top end and a U-shape.

11. The waist belt pouch system according to claim 1, further comprising a second pouch pocket flap is peeled away from the respective pocket via the pouch fastener.

12. The waist belt pouch system according to claim 1, wherein the second communication port incorporates an electronic communication port selected from the group consisting of a USB port, a micro-USB port, a Radio Corporation of America or RCA port, or an optical port.

13. The waist belt pouch system according to claim 1, wherein a first pouch pocket flap is peeled away from the first pouch first pocket via the pouch fastener to illustrate a plurality of first pouch communication ports.

14. The waist belt pouch system according to claim 13, wherein the first communication port incorporates an electronic communication port selected from the group consisting of a USB port, a micro-USB port, a Radio Corporation of America or RCA port, or an optical port.

15. The waist belt pouch system according to claim 1, wherein each of the communication ports are selectively plugged so as to protect the communication port when not in use.

16. The waist belt pouch system according to claim 1, wherein each first communication port has a first communication port plug attached via a first tether immediately subjacent from the first communication port and has a cover portion affixed to the first tether and an extension portion extending away from a side of the cover portion and the first communication port plug is sized and shaped similar to a charging connector of a cord and fully covers the electrical contacts therein.

17. The waist belt pouch system according to claim 1, wherein each of the second communication ports has a second communication port plug attached via a second tether immediately subjacent from the second communication port and the second communication port plug has a cover portion affixed to the second tether and an extension portion extending away from a side of the cover portion and is sized.

18. The waist belt pouch system according to claim 1, wherein each of the second communication ports are shaped similar to a charging connector of a cord and fully covers a plurality of electrical contacts therein.

19. The waist belt pouch system according to claim 1, wherein the waist belt pouch system is particularly suited for individuals who have a plurality of items to carry and a plurality of pockets of pants or shorts are inadequate to carry all of the items.

20. The waist belt pouch system according to claim 1, wherein the waist belt pouch system is able to float on water.

* * * * *